US006126161A

United States Patent [19]

Kato

[11] Patent Number: 6,126,161

[45] **Date of Patent: *Oct. 3, 2000**

[54] SHEET FEEDER HAVING IMPROVED SHEET SEPARATION REGARDLESS OF RIGIDITY AND SIZE OF SHEET

[75] Inventor: Hiroyuki Kato, Nagoya, Japan

[73] Assignee: Brother Kogyo Kabushiki Kaisha, Nagoya, Japan

[ * ] Notice: This patent is subject to a terminal disclaimer.

[21] Appl. No.: 08/922,559

[22] Filed: Sep. 3, 1997

[30] Foreign Application Priority Data

Sep. 6, 1996 [JP] Japan ..... 8-236369

[51] Int. Cl.[7] ..... B65H 3/06; B65H 3/52

[52] U.S. Cl. ..... 271/121; 271/114; 271/124

[58] Field of Search ..... 271/121, 124, 271/126, 114

[56] References Cited

U.S. PATENT DOCUMENTS

| | | | |
|---|---|---|---|
| 4,461,466 | 7/1984 | Uchida et al. | 271/124 X |
| 4,589,646 | 5/1986 | Ozawa et al. | 271/114 X |
| 5,026,042 | 6/1991 | Miller . | |
| 5,386,983 | 2/1995 | Ando | 271/124 X |
| 5,527,029 | 6/1996 | Bortolotti et al. | 271/124 |
| 5,823,524 | 10/1998 | Kawada | 271/124 |
| 5,857,671 | 1/1999 | Kato et al. | 271/121 X |

FOREIGN PATENT DOCUMENTS 2-132018 5/1990 Japan .

*Primary Examiner*—Christopher P. Ellis
*Assistant Examiner*—Gene O. Crawford
*Attorney, Agent, or Firm*—Oliff & Berridge, PLC

[57] ABSTRACT

A sheet feeder providing accurate separation of an uppermost sheet from remaining sheets of a sheet stack stored in a hopper regardless of a size and rigidity of the sheets. The sheet feeder includes a sheet feed roller positioned in confrontation with the hopper for feeding the sheet in a sheet feeding direction. A wall of a frame confronts an outlet end portion of the hopper. The wall is provided with a slanted surface sloping toward the sheet feeding direction, and a stop member protrudable from or retractable into the slanted surface. A recessed portion is open to the slanted surface, and the stop member can be assembled to the recessed portion from an upper open side of the recessed portion. A pair of opposing side walls providing therebetween an upper open space are provided. A rotation shaft of the sheet feed roller can be assembled to the pair of side walls from the upper open space.

18 Claims, 6 Drawing Sheets

SHEET FEEDER HAVING IMPROVED SHEET SEPARATION REGARDLESS OF RIGIDITY AND SIZE OF SHEET

RELATED APPLICATION

The present application is closely related to a commonly assigned co-pending U.S. patent application Ser. No. 08/773,033 filed Dec. 24, 1996.

BACKGROUND OF THE INVENTION

The present invention relates to a sheet feeder having a sheet hopper and a sheet feed roller for delivering each one of the sheets stacked in the hopper to a predetermined location. The present invention also relates to an image forming device having the sheet feeder.

In a known sheet feeder used in a printer, the sheet in the uppermost position of a sheet stack in a sheet hopper is delivered in the specified feed direction by a sheet feed roller which is in contact with the uppermost sheet. In order to separate the uppermost sheet from the remaining sheets of the sheet stack, a corner pawl, a reverse rotation roller or a friction pad is available. However, these require a great deal of assembly work. For example, the corner pawl must be vertically movably attached to a side wall of a sheet cassette, the reverse rotation roller must be disposed below the sheet feed roller in driving connection with a drive source, and the friction pad must be pivotally movably provided while providing a constant contacting pressure with the sheet feed roller.

SUMMARY OF THE INVENTION

In the co-pending application, the sheet feeder includes a sheet feed roller positioned in confrontation with the hopper for feeding the sheet in a sheet feeding direction. An outlet end portion of the hopper is provided with a wall to which the leading edge of the sheet abuts. The wall is provided with a slanted surface sloping toward the sheet feeding direction, and a stop member protrudable from or retractable into the slanted surface. The stop member is biased in the protruding direction by a coil spring. When the sheets having high rigidity are stored in the hopper, the leading edge of the sheet pushes the stop member into the slanted surface and the uppermost sheet is separated from the remaining sheets by the slanted surface. When the sheets having low rigidity are stored, the leading edge of the sheet abuts against the protruding stop member for imparting large bending of the sheet.

It is an object of the present invention to provide a sheet feeder in which assembly of the entire components of the sheet feeder, and particularly the assembly of the stop member can be facilitated.

This and other objects of the present invention will be attained by providing a sheet feeder for feeding each one of cut sheets in a sheet feeding direction, the feeder including a frame on which a sheet feed passage is defined, a hopper, a sheet feed mechanism, a stop member, and a biasing member. The hopper is supported on the frame and houses therein a stack of sheets. The frame has a sheet receiving portion in contact with each leading edge of the sheets. The frame also forms a recessed portion at a position adjacent the sheet receiving portion. The recessed portion has an upper opening open toward the sheet feed passage. The sheet feed mechanism has at least one sheet feed roller disposed in contact with an uppermost sheet of the sheet stack for feeding the uppermost sheet in the sheet feeding direction.

The stop member is positioned in the recessed portion and is pivotally movably supported to the frame between a protruding position protruding from the sheet feed passage and a retracted position retracted from the sheet feed passage. The stop member can be assembled to the frame through the upper opening of the recessed portion. The biasing member is connected to the stop member for urging the stop member to its protruding position. The biasing member provides a biasing force for changing a pivotal posture of the stop member dependent on rigidity of the sheet.

In another aspect of the invention, there is provided an image forming device for forming an image on a cut sheet including the above described sheet feeder, a printing mechanism having a print head which ejects ink toward the cut sheet, and a conveyer mechanism for conveying each one of the cut sheet fed by the at least one sheet feed roller to the printing mechanism.

BRIEF DESCRIPTION OF THE DRAWINGS

In the drawings:

FIG. 5(*b*) shows a state in which the leading edge of the sheet having the low rigidity is slidingly moved along a surface of the stop member;

FIG. 5(*c*) shows a state in which the leading edge has been moved past the stop member and;

DETAILED DESCRIPTION OF THE PREFERRED EMBODIMENTS

A sheet feeder and a printing device having the sheet feeder according to a first embodiment of the present invention will be described with reference to FIGS. 1 through 6 in which the present invention is applied to an ink jet printer.

Figure 1:
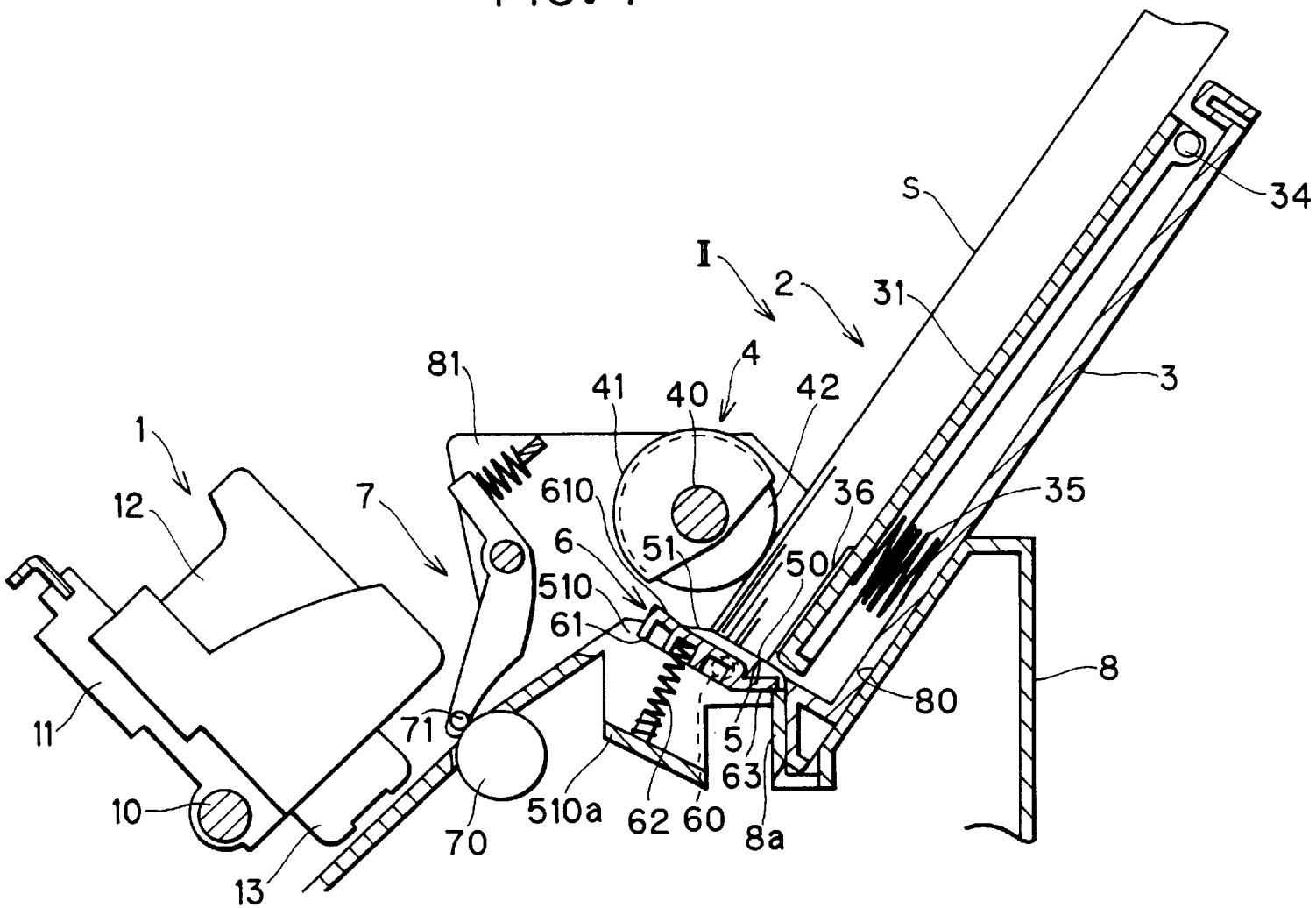
FIG. 1 is a vertical cross-sectional view showing an essential portion including a sheet feeder and bridging from a hopper to a printing mechanism in an ink jet printer according to a first embodiment of the present invention.

In FIG. 1, the ink jet printer includes a printing mechanism 1 which performs printing on a sheet S, a sheet feeder 2 which supplies each one of sheets S of a sheet stack, and a sheet conveyer mechanism 7 for transferring the sheet S supplied from the sheet feeder 2 to the printing mechanism 1. The sheet S is a cut sheet that has been cut to a rectangular shape of specific dimensions.

The printing mechanism 1 is provided with a main frame 8, a carriage 11 that moves back and forth along a guide rail 10, and an ink cartridge 12 and a printing head 13 those supported by the carriage 11. The guide rail 10 extends in a widthwise direction of the sheet S supplied from the sheet feeder 2, that is, in the direction perpendicular to the feeding direction of the sheet S. The guide rail 10 also extends in parallel to the surface of the sheet S.

During printing, while the carriage 11 is moved back and forth by a drive source such as an electric motor (not shown), ink droplets are ejected from the printing head 13 toward the sheet S passing underneath the printing head 13. Thus, an inked image is formed on the sheet S.

The sheet conveyer mechanism 7 includes a conveyor roller 70 and a follower roller 71. These rollers serve as registration means to which a leading edge of the sheet abuts for avoiding diagonal printing. Further, these rollers are adapted to transfer the sheet S to a printing position of the printing mechanism 1, and then intermittently transfer the sheet S by a predetermined amount each time one line printing is completed.

The sheet feeder 2 has a hopper 3 for storing a stack of the sheets S, a feed mechanism 4 for feeding the sheet S from the hopper 3, a wall 5 to which the leading edge of the sheet S fed from the hopper 3 will abut, and a stop mechanism 6 provided to the wall 5. The conveyor mechanism 7 is positioned downstream of the wall 5 in the sheet feeding direction for conveying the sheet S to directly beneath the printing head 13.

The frame 8 is made of a resin and is formed with a hopper receiving recess 80, and the hopper 3 is supported in the recess 80 in an inclined state with the front end side thereof (the discharge end side of the sheet S) facing down.

The inside of the hopper 3 is provided with a lifter plate 31, and the sheet S is stacked on an upper surface of the lifter plate 31. As shown in FIG. 1, the lifter plate 31 is pivotably movably provided about a pivot shaft 34 provided to a rear end side of the hopper 3. A spring 35 is provided for urging the lifter plate 31 toward the feed mechanism 4 for lifting up the leading edge of the sheet S. The pivot shaft 34 extends in parallel to the lateral direction of the sheet S.

Figure 2:
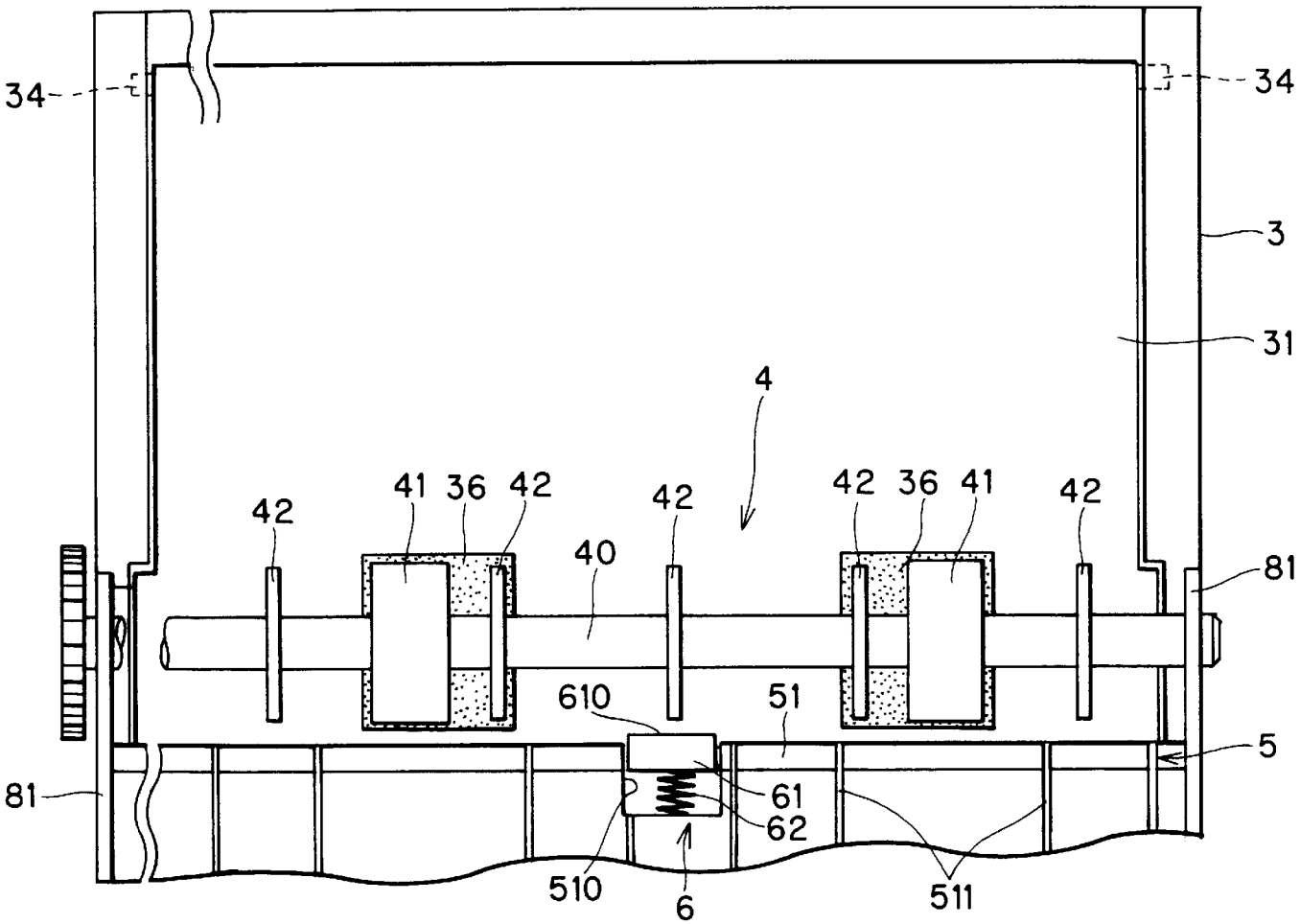
FIG. 2 is a plan view as viewed from a direction of an arrow II in FIG. 1.

As shown in FIG. 2, a pair of friction members 36 are attached to the upper surface of the lifter plate 31 so as to retain the lowermost sheet S in the hopper 3 when the sheets in the hopper 3 is decreased to two or three sheets. The friction members 36 prevents sheets remaining on the hopper 3 from being fed simultaneously. The friction members 36 may be formed of a cork.

Figure 3:
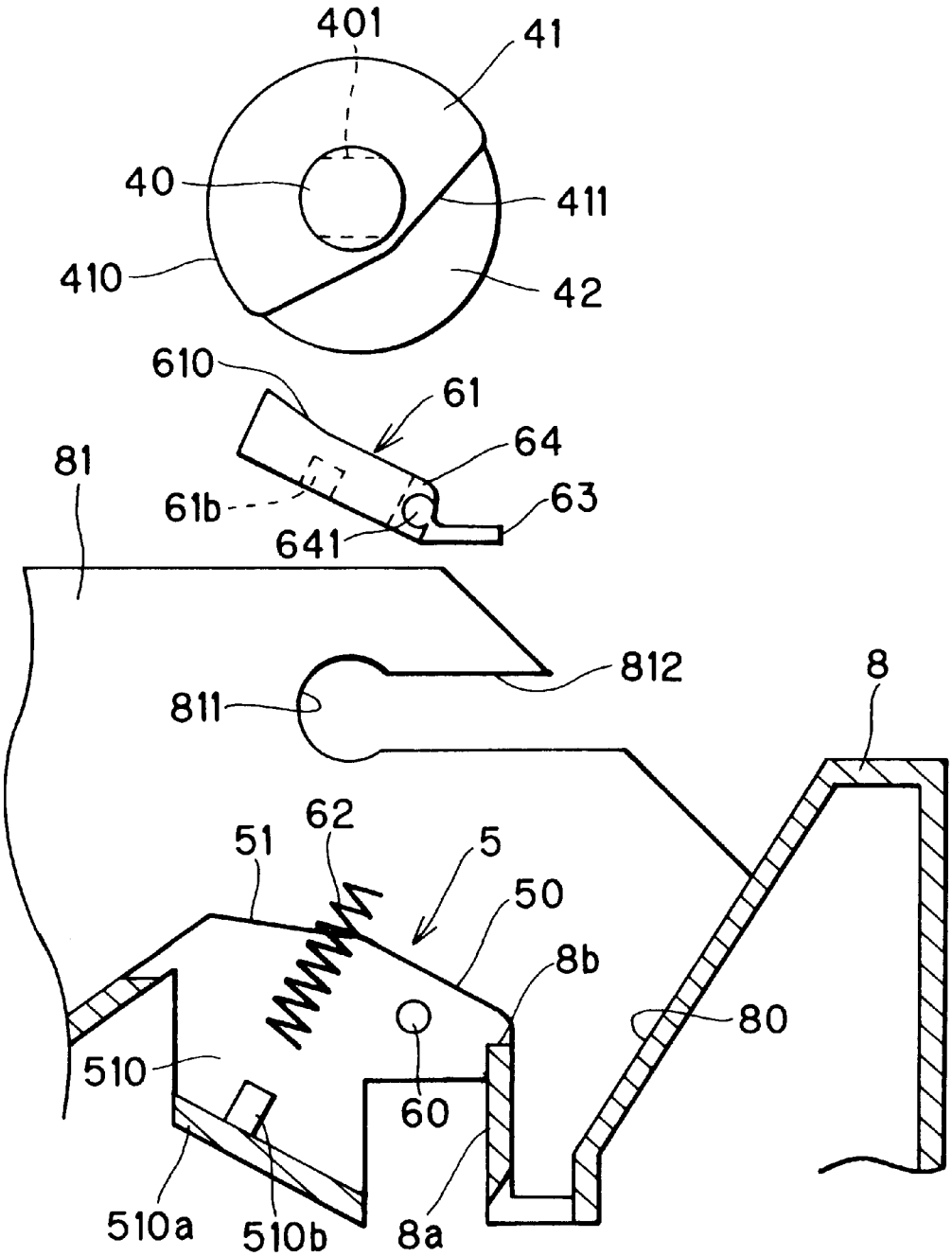
FIG. 3 is an exploded side view showing a sheet feed mechanism and a sheet stop mechanism of the sheet feeder in FIG. 1.

The feed mechanism 4 includes a support shaft 40 extending in parallel to the lateral direction of the sheet S, a pair of sheet feed rollers 41 mounted on the support shaft 40, and five collars 42. A pair of side walls 81 up-stand from the frame 8, and the support shaft 40 is rotatably supported by the side walls 81. The support shaft 40 is rotatable in a clockwise direction in FIG. 1 by a drive source (not shown). As shown in FIG. 3, the support shaft 40 has a pair of cut-away portions 401, so that a distance between the pair of cut-away portion 401 is smaller than a diameter of the support shaft 40. Further, the sheet feed roller 41 has an arcuate or semi-cylindrical portion 410 which is concentric with the support shaft 40, and a chordal portion 411. A combination of the arcuate portion 410 and the chordal portion 411 will provide a generally sector shaped feed roller 41. The sheet feed roller 41 is integrally rotatable with the support shaft 40. The arcuate length of the arcuate portion 410 is long enough in the peripheral direction thereof to feed a single sheet S to a location between the conveyor roller 70 and the follower roller 71 of the conveyor mechanism 7.

The collar 42 is formed in a disk shape and is undetachably rotatable with respect to the support shaft 40. An outer diameter of the collar 42 is set slightly smaller than an outer diameter of the arcuate portion 410 of the sheet feed roller 41. Further, the outer peripheral surface of the collar 42 is positioned radially outwardly from the chordal portion 411.

When the support shaft 40 is rotated in the clockwise direction in FIG. 1, and the arcuate portion 410 of the sheet feed roller 41 is brought into confrontation with the hopper 3, the sheet S which has been lifted by the lifter plate 31 is pressed against the arcuate portion 410, which causes the uppermost sheet S to be pushed out of the hopper 3. When the rotation of the sheet feed roller 41 proceeds and the chordal portion 411 is brought into confrontation with the hopper 3, the portion of the sheet S remaining in the hopper 3 is brought into contact with the outer peripheral surface of the collar 42. As a result, upon completion of the delivery of the sheet S, the collar 42 is rotated in contact with the sheet S because of the feeding of the sheet S fed by the conveyor mechanism 7, while the sheet feed roller 41 is separated from the sheet S. Accordingly, floating of the sheet S can be prevented by the collar 42 until subsequent sheet feeding operation. As a result, the multiple feed (the state of two or more sheets being fed together) caused by the floating of the sheet S can be prevented.

As shown in FIG. 1, the wall 5 is provided integrally with the printer frame 8 at a position within the hopper receiving recess 80. A detail of the wall 5 is best shown in FIG. 3. A sheet receiving surface 50 is formed on the wall 5 for receiving each leading edge of the sheet S. Further, a slanted surface 51 is provided beside and downstream of the sheet receiving surface 50. The sheet receiving surface 50 extends approximately perpendicular to the lifter plate 31, and the slanted surface 51 is angled with respect to the sheet receiving surface 50 in a direction toward the extending direction of the sheet S in the sheet hopper 3. In other words, a combination of the sheet receiving surface 50 and the slanted surface 51 provides an obtuse angled ridge. The sheet S fed from the hopper 3 goes over the wall 5 and moves to the conveyor mechanism 7. Further, a sheet passage is defined by a top surface of the wall 5 and a top surface of the frame 8 so that the sheet S can be fed from the hopper 3 to a position in confrontation with the print head 13.

The frame 8 has an upper open structure at a portion between the pair of the side walls 81, and the upper open end is covered with a cover (not shown) from the feed mechanism 4 to the printing mechanism 1. A recessed portion 510 is formed in the slanted surface 51, and the above-mentioned stop mechanism 6 is located inside this recessed portion 510. The recessed portion 510 is open toward the sheet passage. The upper side of the hopper receiving portion 80 and the recessed portion 510 are open. The width of the sheet passage is defined by the pair of side walls 81, and the upper side of the sheet passage is also open.

The frame 8 has an upstanding portion 8a which supports the front end of the hopper 3. The upstanding portion 8*a* has a top surface 8*b*. As shown in FIG. 2, upwardly projecting linear ribs 511 are formed at the slanted surface 51. These ribs 511 extend in the sheet feeding direction. The uppermost surface of the ribs 511 define the slant angle of the slanted surface 51.

The stop mechanism 6 will be described. The stop mechanism 6 includes pivot shafts 60, a stop member 61, a coil spring 62 and an arm 63. The pivot shafts 60 extend from the printer frame 8 at a position adjacent the recessed portion 510 and an upstream portion of the slanted surface 51 in the sheet feeding direction. The pivot shafts 60 extend in parallel to the lateral direction of the sheet S.

Figure 4:
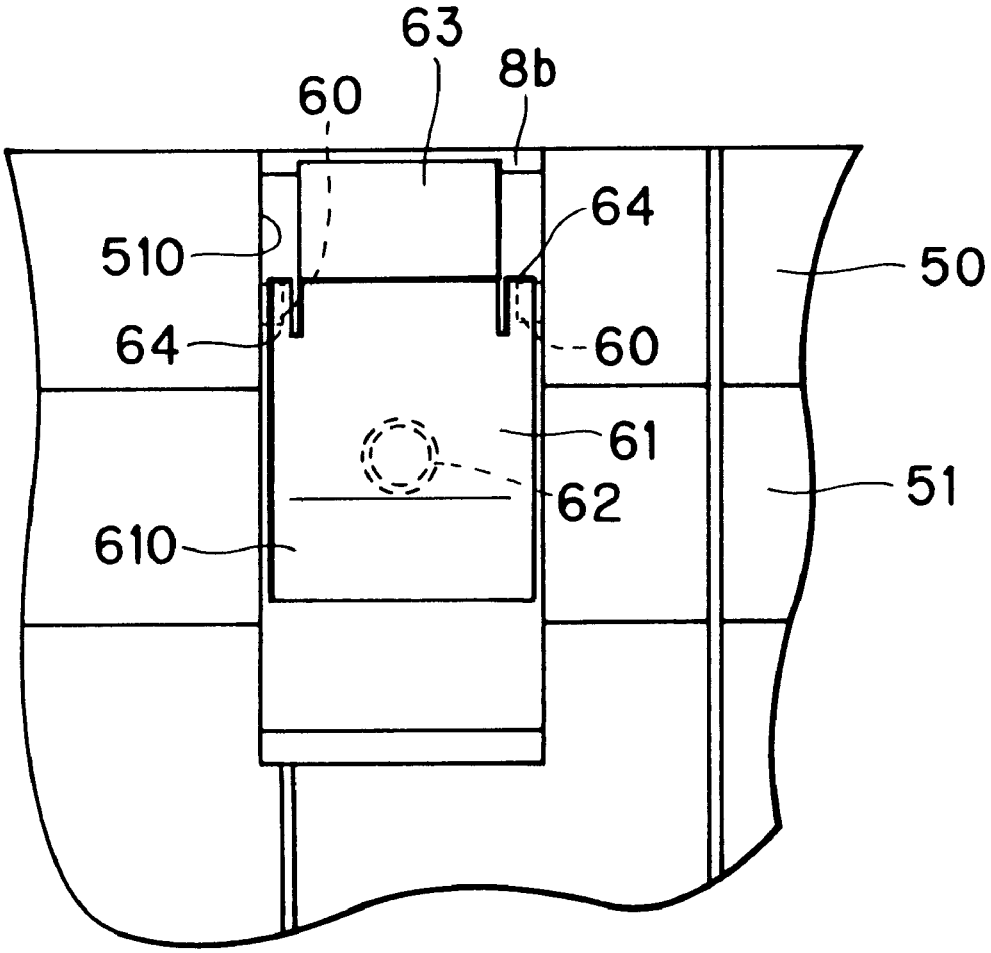
FIG. 4 is a plan view showing the stop mechanism.

The stop member 61 is pivotally movably supported to the pivot shafts 60, and can be projected into and retracted from the slanted surface 51. More specifically, the stop member 61 has a free end surface 610 facing toward the hopper 3 and positioned downstream of the pivot shaft 60, the free end surface 610 being projectable and retractable from the slanted surface 51. The stop member 61 has a bottom surface positioned below the free end surface 610, and a spring receiving hole 61*b* is formed at the bottom surface. The stop member 61 has a pair of lateral sides provided with arm segment 64. The arm segments 64 are formed of a resiliently deformable material and is formed with bearing holes 641 snappingly engageable with the support shafts 60 as shown in FIGS. 3 and 4. Further, an arm 63 extends from the pivot end of the stop member 61. The arm 63 has a free end abuttable on the top surface 8*b* of the upstanding wall 8*a*. The stop member 61 is made from a transparent resin material. The stop member 61 has a sufficient rigidity capable of maintaining a constant shape against force from the sheet S abutting onto the free end surface 610. The recessed portion 510 has a bottom wall 510*a* from which a projection 510*b* protrudes upwardly.

The coil spring 62 has an upper end seated in the spring receiving hole 61*b* of the stop member 61 and a lower end engaged with the projection 510*b*. Therefore, the stop member 61 is normally urged by the coil spring 62, so that the free end of the stop member 61 protrudes out of the slanted surface 51. The coil spring 62 has a proper biasing force for providing a suitable projecting amount of the stop member 61 from the slanted surface 51 in accordance with rigidity of the sheet S, so that the stop member 61 can protrude from or retract into the slanted surface 51 in accordance with the rigidity of the sheet S, which ensures a sheet separation effect suited to the rigidity of the sheet S.

In the protruding state of the stop member 61, the free end surface 610 and the slanted surface 51 define an obtuse angle. The abutment of the free end of the arm 63 against the top surface 8*b* defines the most protruding position of the stop member 61 from the slanted surface 51. In a state in which the stop member 61 is protruding from the slanted surface 51, the slope of the free end surface 610 is greater than that of the slanted surface 51 with respect to the sheet feeding direction.

As shown in FIG. 3, the pair of side walls 81 are formed with grooves 812 and bearing bores 811 in communication with the grooves 812. The bearing bores 811 are adapted for rotatably supporting the support shaft 40. Further, a width of the groove 812 is smaller than a diameter of the bearing bore 811, but greater than the distance between the pair of cut-away portions 401, 401. Therefore, each end of the support shaft 40 can be inserted through each open end of the groove 812, and can be held in each bearing bore 811.

Figure 6:
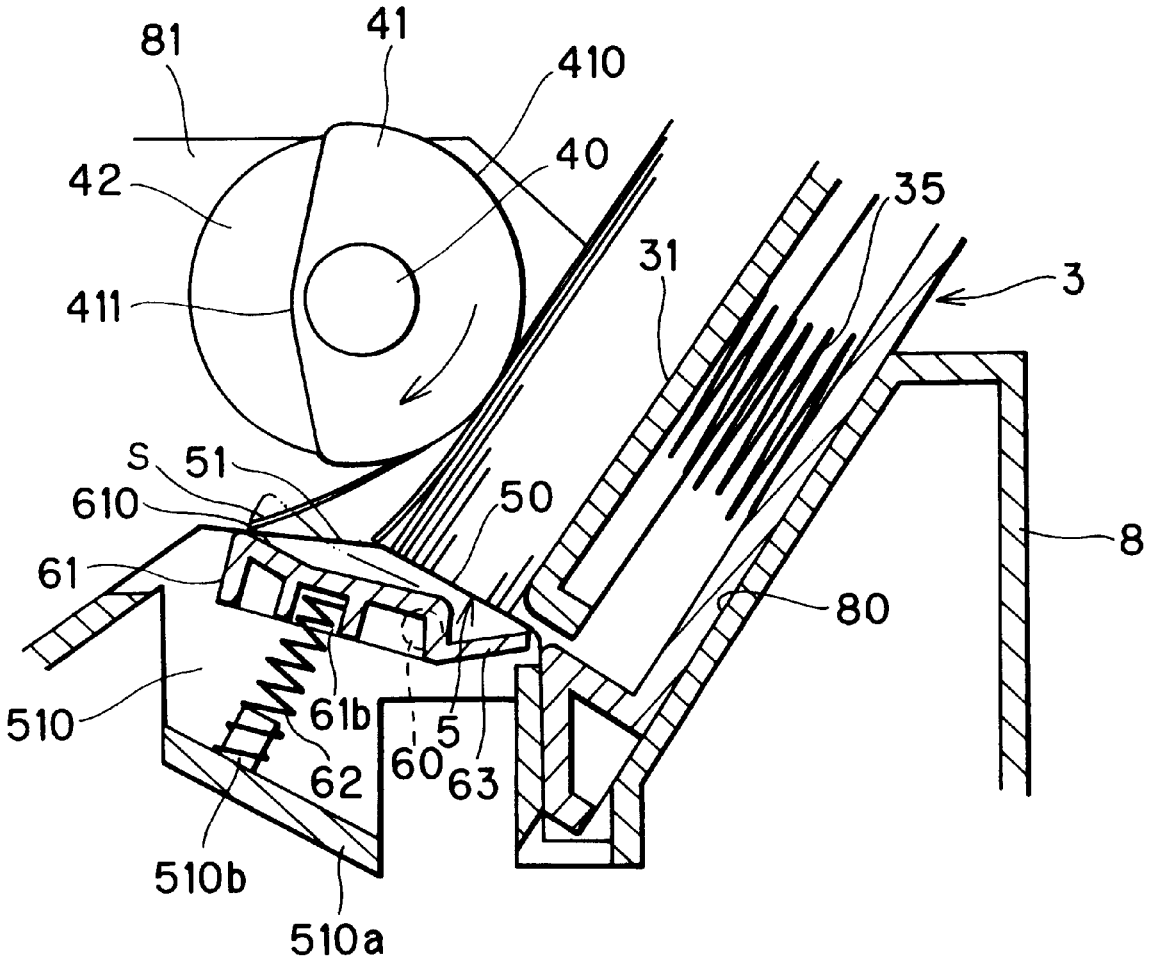
FIG. 6 is a cross-sectional view showing a state in which a leading edge of a sheet having relatively high rigidity moves over the stop member.

When a sheet S having high rigidity (such as a postcard, envelope, or other thick sheet) presses on the free end surface 610, the stop member 61 is pushed into about the same plane as the slanted surface 51 as indicated by a solid line in FIG. 6 due to high rigidity of the sheet, and the leading edge of the sheet S slides over the slanted surface 51 as the sheet S is fed from the hopper 3. In this instance, even if a plurality of sheets S are fed simultaneously from the hopper 3, these sheets S are easily separated from one another by means of the flexion thereof when the leading edge is slidingly moved along the slanted surface 51. As a result, only the uppermost sheet S is pushed by the sheet feed roller 41 and goes over the slanted surface 51.

Figure 5A:
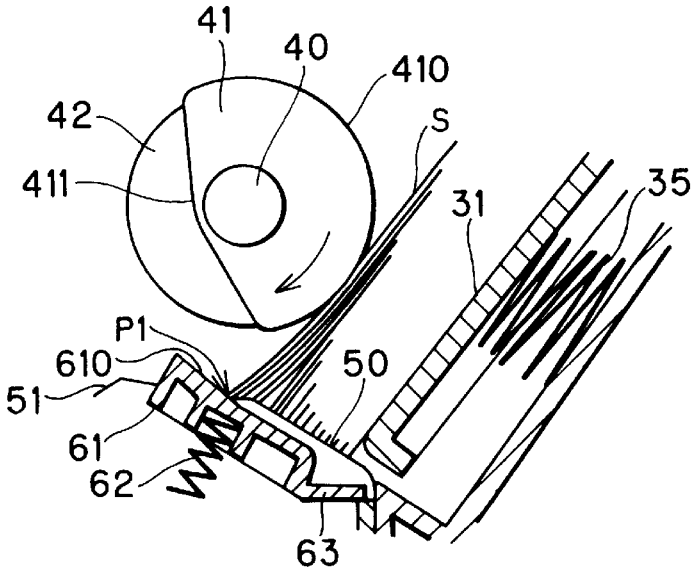
FIGS. 5(*a*) through 5(*c*) are cross-sectional views showing a state in which a stop member is at its most protruding position; and in which FIG. 5(*a*) shows a state in which a leading edge of a sheet having a low rigidity abuts a portion P1.
Figure 5B:
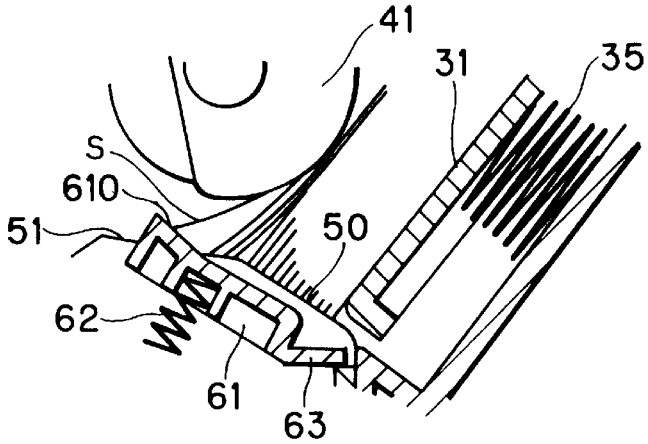
Figure 5C:
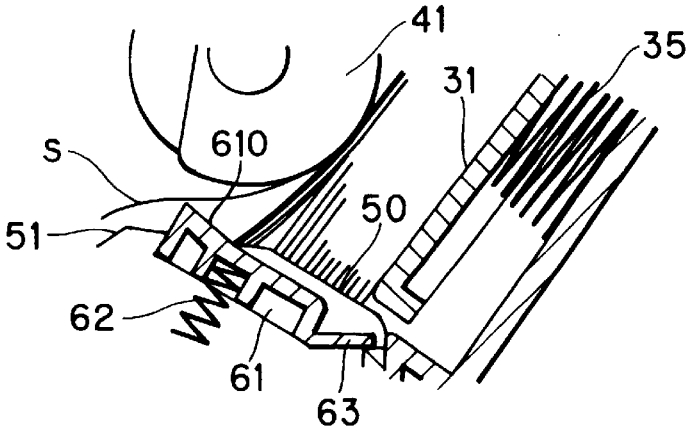

On the other hand, when a thin sheet S having low rigidity abuts the stop member 61, as shown in FIG. 5(*a*), the stop member 61 cannot be retracted into the slanted surface 51 but maintains its protruding posture with respect to the slanted surface 51 by the biasing force of the coil spring 62, because the biasing force is greater than the rigidity of this sheet S. Thus, the sheet S is fed up and over the stop member 61, as shown in FIGS. 5(*b*) and 5(*c*). In this case, the leading edge of the sheet S is largely bent in comparison with the case where the stop member 61 is positioned beneath the slanted surface 51. Accordingly, sufficient separation is achieved even with sheet S having low rigidity, and the sheet S positioned below the uppermost sheet is effectively retained by the stop member 61.

In this way, the sheet S having low rigidity can be separated exclusively by the stop member 61. Therefore, the slope angle of the slanted surface 51 can be properly set taking the separation effect of only the sheet S having high rigidity into consideration. This allows a variety of types of sheet S to be separated effectively regardless of the rigidity of the sheet.

For assembly, the stop mechanism 6, the feed mechanism 4, and the hopper 3 can be successively assembled to the frame 8 from the upper side thereof. First, the stop member 61 is placed in the recessed portion 510 from its upper side, and the bearing holes 641 of the arm segments 64 are snappingly engaged with the pivot shafts 60 extending from the frame 8. As a result, the stop member 61 is supported pivotably about the pivot shafts 60. The coil spring 62 is compressedly interposed between the spring receiving hole 61*b* of the stop plate 61 and the projection 510*b* of the frame 8 during assembly of the stop member 61 to the frame 8. In this case, the seating position of the coil spring 62 can be visually acknowledged because the stop member 61 is formed of the transparent material. Upon completion of assembly of the stop member 61, the stop member 61 is urged to be rotated in a clockwise direction in FIG. 3 because of the biasing force of the coil spring 61. However, this rotation is limited by the abutment of the arm 63 onto the top surface 8*b* of the upstanding wall portion 8*a*.

Then, the feed mechanism 4 is attached to the frame 8. As described above, because the sheet feed rollers 41 and the five collars 42 are provided undetachably from the support shaft 40, these components can be concurrently attached to the frame 8. More specifically, the both axial end portions of the support shaft 40 is inserted into the grooves 812 formed in the pair of side walls 81 in such a manner that the pair of cut-away portions 401 of the support shaft 40 are in mating contact with the surfaces of the grooves 812. Then, these components are moved toward the bearing bores 811 until the support shaft 40 is received in the bearing bores 811. Thus, the support shaft 40 is rotatably supported by the pair of side walls 40.

Then, for setting the hopper 3 on the hopper receiving recess 80, the front end of the hopper 3 is inserted from beneath the rearward side of the sheet feed rollers 41. Thus, the stop mechanism 6, the feed mechanism 4 and the hopper 3 are successively assembled to the frame 8 without any difficulty.

While the invention has been described in detail and with reference to the specific embodiments thereof, it would be apparent to those skilled in the art that various changes and modifications may be made therein without departing from the spirit and scope of the invention.

For example, in the illustrated embodiment, the slanted surface 51 has a flat plane. However, a curved surface is also available as the slanted surface 51.

Further, in the depicted embodiment, the stop member 61 has bearing holes 641 and the frame 8 has pivot shafts 60 in the recessed portion 510. However, the stop member can provide the pivot shafts and the frame 8 can provide the bearing holes.

Further, in the depicted embodiment, the stop member 61 is formed with the spring receiving hole 61*b* and the bottom wall 510*a* of the recessed portion 510 has the projection 510*b* for interposing the coil spring 61 therebetween. However, the stop member 61 can be provided with a projection and the bottom wall 510*a* can be formed with a hole.

Further, in the depicted embodiment, each side wall 81 is formed with the bearing bore 811 and the groove 812. However, the groove 812 is not necessary with respect to one of the side walls 81. In this case, one axial end portion of the support shaft 40 is directly inserted into the bearing bore of the one of the side walls. Then, the other axial end portion of the support shaft 40 is aligned with the opening of the groove 812 of the other side wall and is slidingly moved within the groove 812 in such a manner that the support shaft 40 is swingingly moved about the bearing hole of the one of the side walls at which no groove is formed until the other end portion of the support shaft 40 is received in the bearing bore of the other side wall.

Further, the area of the stop member 61 occupying the slanted surface 51 is not limited to the depicted drawings, but can be increased, and the stop member 61 can be formed of a rubber slightly deformable by the urging force from the sheet S. In the latter case, the kind of sheet separable from each other can be increased as long as the leading edge of the sheet can be selectively contacted with slanted surface 51 or the free end surface 610 of the stop member 61 depending on rigidity of the sheet S.

Further, the sheet feeder of the present invention can also be applied to other printers, such as a laser printer, a copying machine, a facsimile, as well as to the ink jet printer. Further, the present invention can also be applied to a sheet feeder which holds the sheets in a horizontal orientation.

What is claimed is:

1. A sheet feeder for feeding each one of cut sheets in a sheet feeding direction comprising:

a frame on which a sheet feed passage is defined;

a hopper supported on the frame and housing therein a stack of sheets, the frame having a sheet receiving portion in contact with each leading edge of the sheets, the frame also forming a recessed portion at a position adjacent the sheet receiving portion, the recessed portion having an upper opening open toward the sheet feed passage, the frame including a pair of side walls defining an upper open space therebetween, the recessed portion and the sheet receiving portion being positioned in the upper open space;

a sheet feed mechanism having at least one sheet feed roller disposed in contact with an uppermost sheet of the sheet stack for feeding the uppermost sheet in the sheet feeding direction;

a stop member positioned in the recessed portion and pivotally movably supported by the frame between a protruding position protruding into the sheet feed passage and a retracted position retracted from the sheet feed passage, the stop member being assembled to the frame through the upper opening of the recessed portion; and a biasing member connected to the stop member that urges the stop member to its protruding position, the biasing member providing a biasing force dependent on the rigidity of the sheet that controls a protruding amount of the protruding position to create a bend in a leading edge of the sheet that increases when sheet rigidity decreases so as to ensure sheet separation.

2. The sheet feeder as claimed in claim 1, wherein the recessed portion has opposing side faces, and the stop member has opposing sides extending in parallel with the sheet feeding direction, the opposing side faces having one of pivot shafts and bearing holes, and the opposing sides having one of bearing holes and pivot shafts, the pivot shafts being engageable with the bearing holes in assembling the stop member to the frame.

3. The sheet feeder as claimed in claim 1, wherein the frame further includes a recessed area on which the hopper is detachably mounted.

4. The sheet feeder as claimed in claim 1, wherein the recessed portion has opposing side faces, and the stop member has opposing sides extending in parallel with the sheet feeding direction, the opposing side faces having one of pivot shafts and bearing holes, and the opposing sides having one of bearing holes and pivot shafts, the pivot shafts being engageable with the bearing holes in assembling the stop member to the frame, the sheet feed mechanism further comprising a support shaft to which the at least one sheet feed roller is provided, and the frame further comprises a pair of opposing side walls defining an upper open space, the support shaft being assembled to the opposing side walls from the upper open space, and a recessed area providing an upper space, the hopper being detachably mounted to the recessed area from the upper space.

5. The sheet feeder as claimed in claim 1, wherein the recessed portion has a bottom surface, and the biasing member comprises a coil spring interposed between the stop member and the bottom surface.

6. The sheet feeder as claimed in claim 5, wherein the stop member is formed of a transparent material, whereby seating position of the coil spring is visible through the transparent stop member.

7. The sheet feeder as claimed in claim 1, wherein the frame further provides a slanted surface positioned immediately downstream of the sheet receiving surface in the sheet feeding direction, the slanted surface having an upper surface serving as a part of the sheet feed passage.

8. The sheet feeder as claimed in claim 7, wherein the upper opening of the recessed portion is open to the slanted surface, the stop member being protrudable beyond the slanted surface and retractable into the slanted surface.

9. The sheet feeder as claimed in claim 8, wherein the slanted surface is angled with respect to the sheet receiving surface in a direction toward the sheet feeding direction defined by an orientation of the sheets in the hopper.

10. The sheet feeder as claimed in claim 1, wherein the sheet feed mechanism further comprises a support shaft to which at least one sheet feed roller is provided, and the support shaft is rotatably supported by the pair of side walls.

11. The sheet feeder as claimed in claim 10, wherein each of the side walls is formed with a bearing bore for rotatably receiving an axial end portion of the support shaft, and at least one of the side walls is formed with a groove having one end in communication with the bearing bore and having another end open to a perimeter of the side wall.

12. The sheet feeder as claimed in claim 11, wherein the bearing bore has a diameter greater than a width of the groove, and the support shaft has a pair of cut away portions opposing each other, a distance between the opposing cut away portions being smaller than a width of the groove.

13. The sheet feeder as claimed in claim 1, wherein the biasing member, the stop member and the sheet feed mechanism are manually assembled into the frame from the upper side of the frame without the use of tools.

14. An image forming device for forming an image on a cut sheet comprising:

a frame on which a sheet feed passage is defined;

a sheet feeder for feeding each one of cut sheets in a sheet feeding direction;

a printing mechanism having a print head that ejects ink toward the cut sheet; and a conveyer mechanism that conveys each one of the cut sheets fed by the sheet feeder to the printing mechanism, wherein the sheet feeder includes:

a hopper supported on the frame and housing therein a stack of sheets, the frame having a sheet receiving portion in contact with each leading edge of the sheets, the frame also forming a recessed portion at a position adjacent the sheet receiving portion, the recessed portion having an upper opening open toward the sheet feed passage;

a sheet feed mechanism having at least one sheet feed roller disposed in contact with an uppermost sheet of the sheet stack for feeding the uppermost sheet of the sheet stack for feeding the uppermost sheet in the sheet feeding direction;

a stop member positioned in the recessed portion and pivotally movably supported by the frame between a protruding position protruding into the sheet feed passage and a retracted position retracted from the sheet feed passage, the stop member being assembled to the frame through the upper opening of the recessed portion; and a biasing member connected to the stop member that urges the stop member to its protruding position, the biasing member providing a biasing force dependent on the rigidity of the sheet.

15. The image forming device as claimed in claim 14, wherein the recessed portion has opposing side faces, and the stop member has opposing sides extending in parallel with the sheet feeding direction, the opposing side faces having one of pivot shafts and bearing holes, and the opposing sides having one of bearing holes and pivot shafts, the pivot shafts being engageable with the bearing holes in assembling the stop member to the frame, the sheet feed mechanism further comprises a support shaft to which the at least one sheet feed roller is provided, and the frame further comprises a pair of opposing side walls defining an upper open space, the support shaft being assembled to the opposing side walls from the upper open space, and a recessed area providing an upper space, the hopper being detachably mounted to the recessed area from the upper space.

16. The image forming device as claimed in claim 14, wherein the frame includes a pair of side walls that define therebetween an upper open space, the sheet receiving portion and the recessed portion being positioned within the upper open space.

17. The image forming device as claimed in claim 14, wherein the conveyor mechanism comprises a conveyer roller and a follower roller in nipping relation to the conveyer roller, the conveyer roller and the follower roller being positioned downstream of the stop member in the sheet feeding direction for conveying the sheet fed by the at least one sheet feed roller to an intended location.

18. The sheet feeder as claimed in claim 14, wherein the sheet feed mechanism further comprises a collar for pressing the uppermost sheet on the hopper, the uppermost sheet bridging between the conveyer roller and the collar under tension to provide a non-slackened state at a position above the slanted surface.

* * * * *